US007488093B1

(12) United States Patent
Huang et al.

(10) Patent No.: US 7,488,093 B1
(45) Date of Patent: Feb. 10, 2009

(54) LED LAMP WITH A COVER AND A HEAT SINK

(75) Inventors: Chung-Yuan Huang, Santa Clara, CA (US); Jer-Haur Kuo, Taipei Hsien (TW); Xin-Xiang Zha, Shenzhen (CN); Ye-Fei Yu, Shenzhen (CN)

(73) Assignees: Fu Zhun Precision Industry (Shen Zhen) Co., Ltd., Shenzhen , Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/107,779

(22) Filed: Apr. 23, 2008

(30) Foreign Application Priority Data

Dec. 27, 2007 (CN) ..... 200710186115.4

(51) Int. Cl.
*F21V 29/00* (2006.01)

(52) U.S. Cl. ..... 362/294; 362/373; 362/431

(58) Field of Classification Search ..... 362/294, 362/373, 431

See application file for complete search history.

(56) References Cited

U.S. PATENT DOCUMENTS

| | | | | |
|---|---|---|---|---|
| 2007/0086196 | A1 | 4/2007 | Wong | |
| 2007/0090737 | A1 * | 4/2007 | Hu et al. | 313/11 |
| 2008/0043479 | A1 * | 2/2008 | Wang | 362/373 |
| 2008/0212324 | A1 * | 9/2008 | Lin | 362/287 |

* cited by examiner

*Primary Examiner*—Thomas M Sember
(74) *Attorney, Agent, or Firm*—Frank R. Niranjan

(57) ABSTRACT

An LED lamp (100) includes a frame (12), at least one LED module (20), a heat sink (32) and a cover (50). The LED module has a plurality of LEDs (220). The heat sink is mounted on the frame. The at least one LED module is attached to a bottom of the heat sink, whereby heat generated by the LEDs can be dissipated by the heat sink. A heat pipe (35) interconnects the heat sink and the cover. Thus, the heat generated by the LEDs can also be dissipated by the cover via the heat pipe. The cover is secured so as to shield a top portion of the heat sink and space from the top portion of the heat sink.

16 Claims, 5 Drawing Sheets

LED LAMP WITH A COVER AND A HEAT SINK

BACKGROUND OF THE INVENTION

1. Field of the Invention

The present invention relates to a light emitting diode (LED) lamp, and more particularly to an LED lamp incorporating a cover and a heat sink for increasing a heat dissipation thereof.

2. Description of Related Art

As an energy-efficient light, an LED lamp has a trend of substituting for the fluorescent lamp for a lighting purpose. In order to increase the overall lighting brightness, a plurality of LEDs are often incorporated into a lamp, in which how to efficiently dissipate heat generated by the plurality of LEDs becomes a challenge.

Conventionally, an LED lamp used as a street lamp comprises an enclosure and a plurality of LEDs mounted in the enclosure. A heat sink having a plurality of metal fins is attached to an outer side of the enclosure to dissipate heat. However, since the fins of the heat sink are exposed to ambient air, the fins are often covered with dust, snow or ice after a longtime use of the LED lamp. The dust can hamper the heat dissipating effectiveness of the heat sink. The snow or ice on the heat sink, if too much, possibly causes a heavy load on the LED lamp which may result in a breaking of a lamp post of the LED lamp.

What is needed, therefore, is an LED lamp with a heat sink and a cover which can overcome the above-mentioned disadvantages.

SUMMARY

An LED lamp includes a frame, at least one LED module, a heat sink and a cover. The LED module has a plurality of LEDs. The heat sink is mounted on the frame. The heat sink is attached to a side of the LED module for dissipating heat generated by the LEDs of the LED module. A heat pipe interconnects the heat sink and the cover. The cover is secured so as to shield a top portion of the heat sink and space from the top portion of the heat sink. In addition to the heat sink which can dissipate the heat generated by the LEDs, the heat is also dissipated by the cover via the heat pipe. Furthermore, the cover can shield the heat sink from dust, snow, ice and so on.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
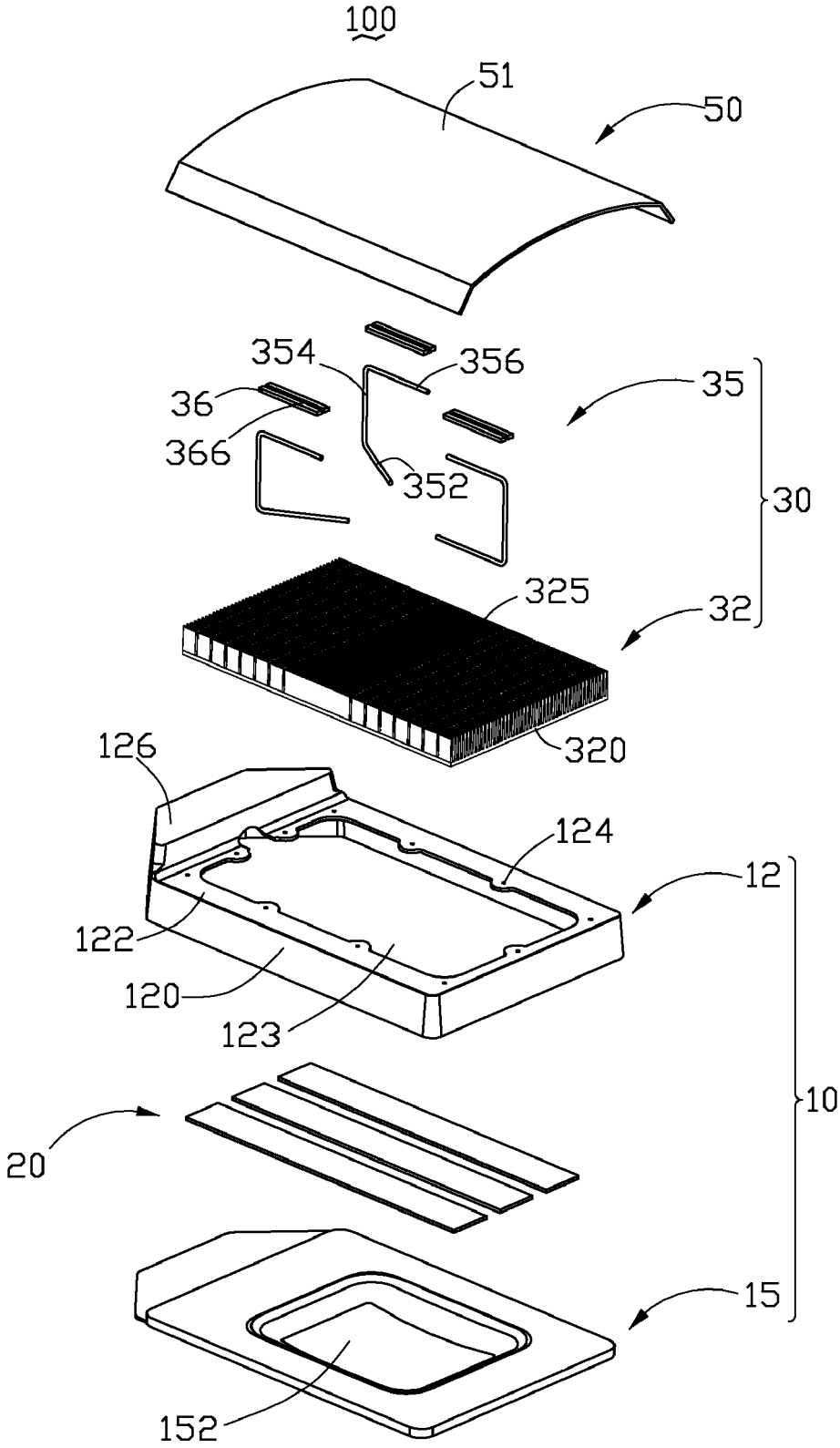
FIG. 1 is an exploded, isometric view of an LED lamp with a heat sink in accordance with a preferred embodiment of the present invention.
Figure 2:
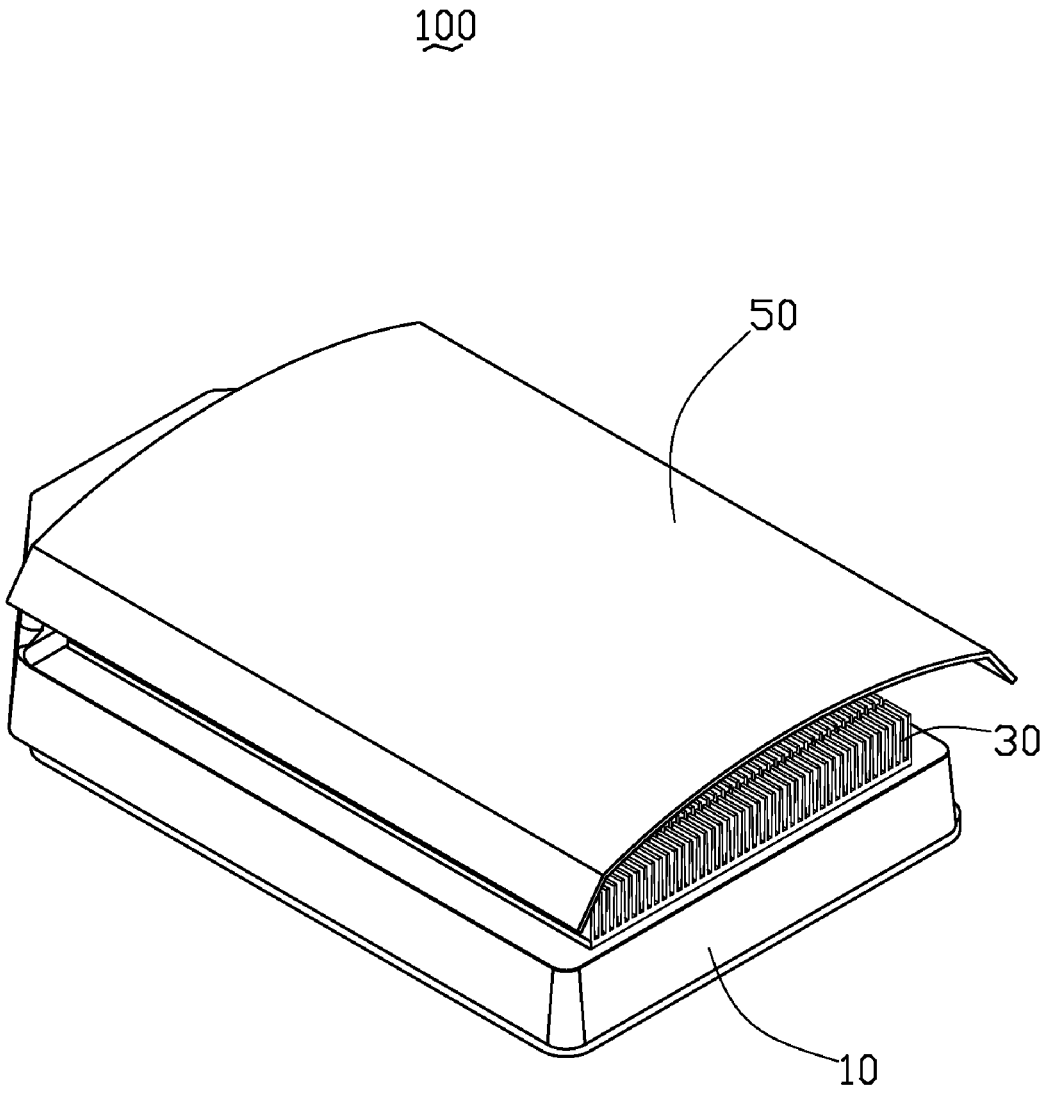
FIG. 2 is an assembled, isometric view of the LED lamp shown in FIG. 1.

Referring to FIGS. 1 and 2, an LED lamp 100 in accordance with a preferred embodiment of the present invention is shown. The LED lamp 100 comprises a lamp enclosure 10, a plurality of LED modules 20, a thermal module 30 and a cover 50. The LED modules 20 are received in the lamp enclosure 10 for generating light. The thermal module 30 is attached to a top portion of the lamp enclosure 10 and contacts the LED modules 20 for dissipating heat generated by the LED modules 20. The cover 50 is retained above a top of the thermal module 30 for covering the thermal module 30.

The lamp enclosure 10 has a casing 12 and a panel 15. The panel 15 has a transparent window 152 in a center thereof and is attached to a bottom of the casing 12. The casing 12 comprises a rectangular frame 120 and a connecting portion 126 at a lateral side of the rectangular frame 120. The frame 120 defines a room 123 for receiving the LED modules 20 therein. The frame 120 has a rectangular, ring-shaped flange 122 extending inwardly from a top portion thereof. The flange 122 is located over the room 123 for supporting the thermal module 30 thereon. The flange 122 defines a plurality of fixing holes 124 therein. The connecting portion 126 defines a fixing hole 1262 (shown in FIG. 3) outside a lateral side of the frame 120.

Figure 3:
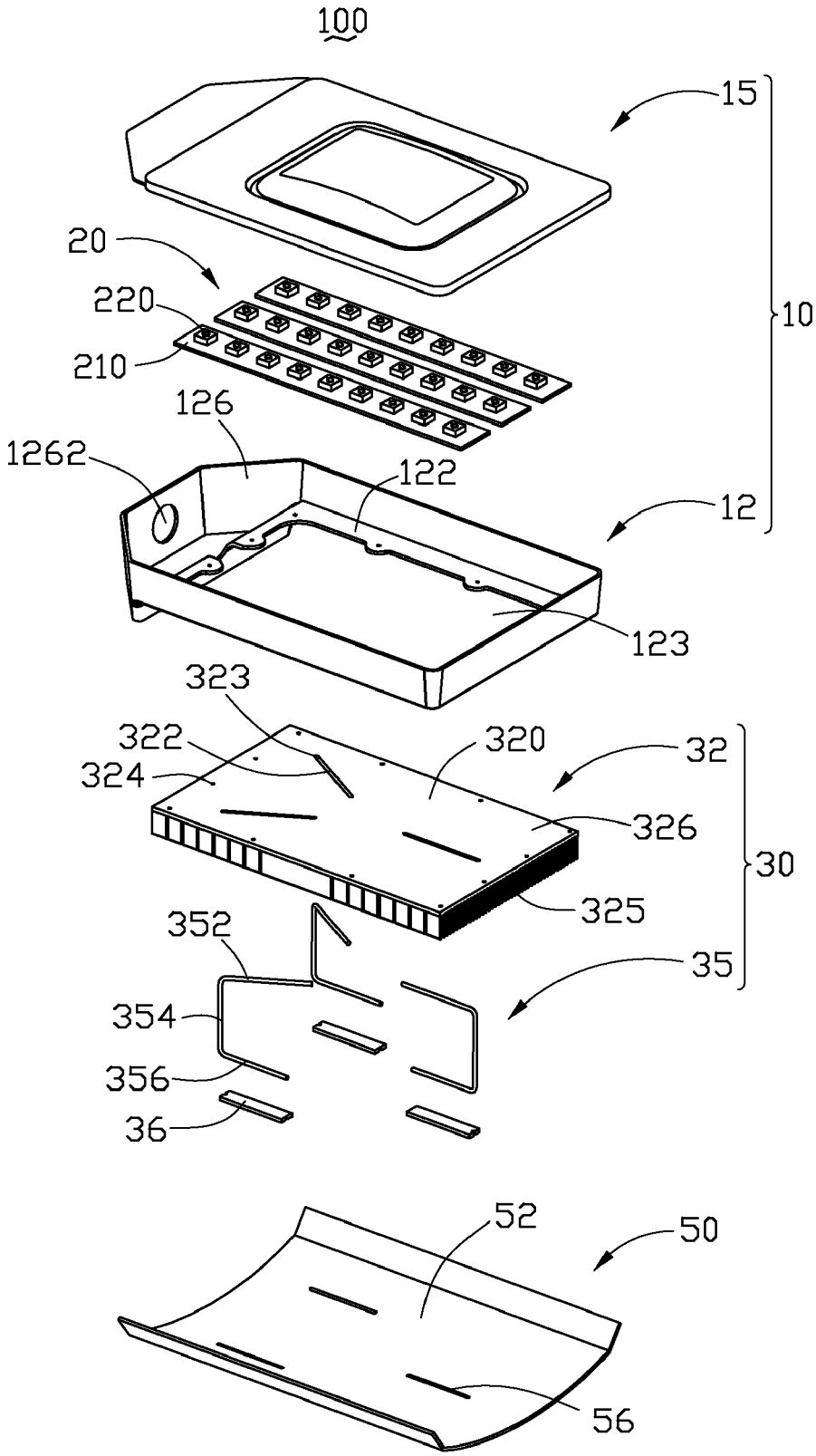
FIG. 3 is a view similar to FIG. 1, but viewed from an opposite bottom aspect.

Also referring to FIG. 3, each of the LED modules 20 comprises a base 210 having a rectangular shape, and a plurality of LEDs 220 equidistantly mounted on the base 210. Preferably, the base 210 is a printed circuit board. The LED modules 20 space from each other in a uniform interval. The LED modules 20 are mounted on the thermal module 30 so that heat generated by the LEDs 220 of the LED modules 20 can be dissipated by the thermal module 30.

The thermal module 30 comprises a heat sink 32 and three heat pipes 35 connecting to the heat sink 32. The heat sink 32 is made of metal having good heat conduction, such as aluminum. Preferably, the heat sink 32 is formed by aluminum extrusion. The heat sink 32 comprises a flat, rectangular base 320 and a plurality of fins 325 extending from a top portion of the base 320. The base 320 has a bottom portion 326. The bottom portion 326 horizontally defines three grooves 322. The grooves 322 extend radially and outwardly from a center of the base 320. The grooves 322 are oriented to extend from a center of the base 320 to edges of the base 320. The extension directions of the grooves 322 are different from each other as ends of the grooves 322 adjacent to edges locating at three corresponding points of a triangle. The end of each groove 322 defines a through hole 323 vertically extending through the base 320 and the fins 325 till communicating a top of the heat sink 32.

A plurality of screw holes 324 are defined at edges of the base 320. Each of the heat pipes 35 is bended to have a generally U-shaped configuration. Each heat pipe 35 has a horizontal evaporator 352, a vertical connection 354 and a horizontal condenser 356. The evaporator 352 and the condenser 356 respectively connect with two ends of the connection 354. The evaporator 352 and the condenser 356 form an acute angle therebetween, as seen from a top of the heat pipe 35. It is to be understood that the evaporator 352 and the condenser 356 can locate at a same vertical plane. A length of the connection 354 of each heat pipe 35 is longer than a vertical length of the heat sink 32. Three rectangular boards 36 made of metal having good heat conduction are respectively coupled the condensers 356 of the heat pipes 35. Each of the boards 36 has an elongate groove 366 having a shape corresponding to a half part of the condenser 356, whereby the condenser 356 can be conformably received in the elongate groove 366. The boards 36 are used to secure the condensers 356 to the cover 50.

The cover 50 is made of metal having light weight and good heat conduction, such as aluminum. The cover 50 has an arch shape and provides a shielding area covering a whole top portion of the heat sink 32 of the thermal module 30. The cover 50 has an outer surface 51 having a protruding shape and an internal surface 52 having a concave shape. The outer surface 51 is a smooth surface. The internal surface 52 is oriented towards the fins 325. The internal surface 52 defines three elongate grooves 56 each having a semicircle-shaped cross section corresponding to the condenser 356 of each of the heat pipes 35. The three grooves 56 are approximately located in three points of a triangle. Extension directions of the three elongate grooves 56 are parallel to each other. It is to be understood that the extension directions of the three elongate grooves 56 can be positioned in an interlaced arrangement.

Figure 4:
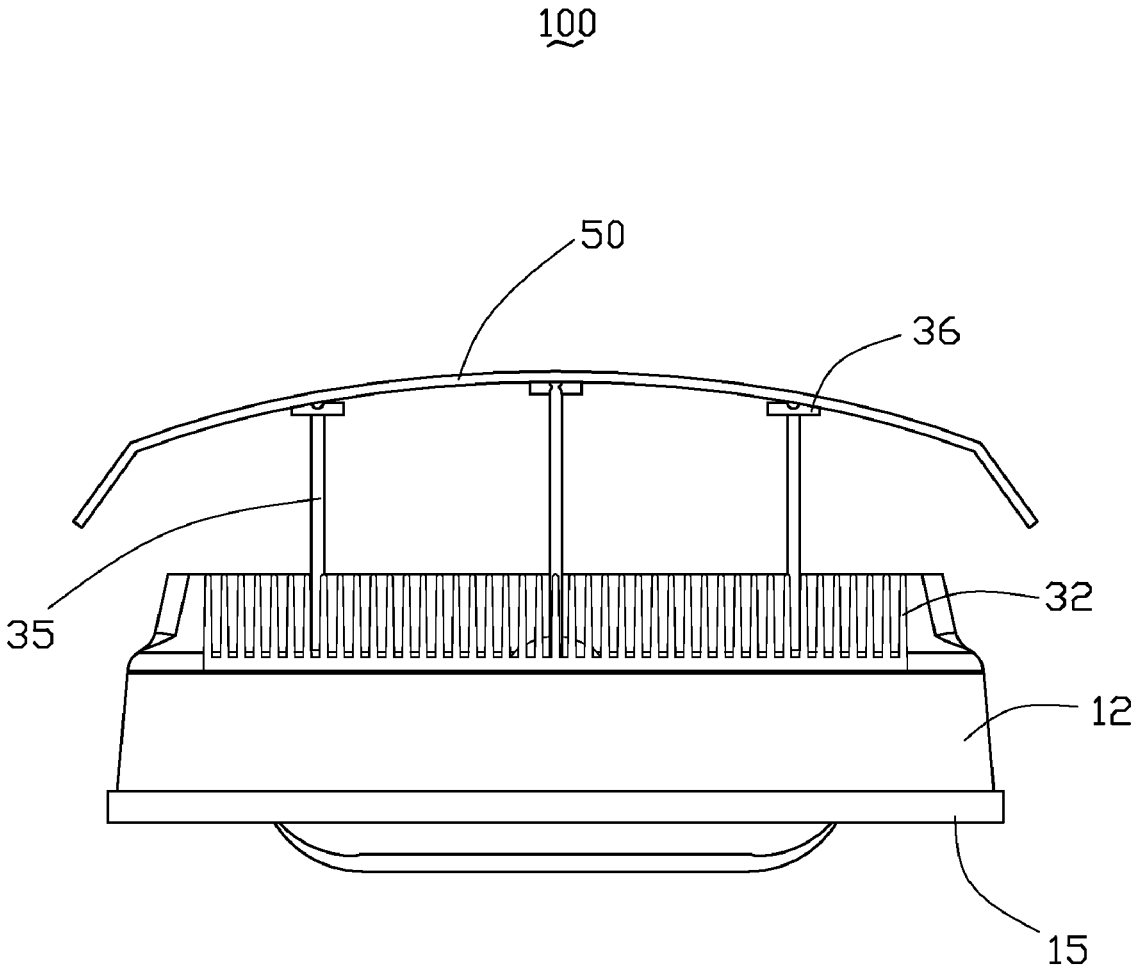
FIG. 4 is a right side view of the LED lamp shown in FIG. 2.

Please referring to FIG. 4, in assembly, firstly, the thermal module 30 is assembled by following steps: the evaporators 352 of the heat pipes 35 respectively extend through the through holes 323 from a top of the heat sink 32 to be received in the grooves 322. Then, the evaporators 352 are fixed to the base 320 by soldering.

Secondly, the thermal module 30 is connected to the lamp enclosure 10 by following steps: the base 320 of the heat sink 32 is attached to the flange 122 of the frame 120 by extending screws (not shown) through the fixing holes 124 of the flange 122 respectively to threadedly engage in the screw holes 324 of the base 320. Thus, the thermal module 30 is secured to the lamp enclosure 10.

Thirdly, the LED modules 20 are assembled by following steps: thermal grease is spread on the bottom portion 326 of the base 320; then, the bases 210 of the LED modules 20 are attached to the bottom portion 326 by means of screwing or fastening.

Fourthly, the cover 50 is assembled by following steps: the cover 50 is brought to shield a top portion of the thermal module 30. Half parts of the condensers 356 of the heat pipes 35 are respectively received in the grooves 56 of the cover 50. Then, the boards 36 are attached to the internal surface 52 of the cover 50 by soldering or screwing, whereby, the grooves 366 of the boards 36 respectively receive the other half parts of the condensers 356 of the heat pipes 35 therein. For enhancing heat conduction between the cover 50 and the boards 36, thermal grease can be spread on interface surfaces of the cover 50 and the boards 36.

The condensers 356 which are higher than a top portion of the fins 325 result in the internal surface 52 of the cover 50 spacing from the fins 325. Also, the lateral sides of the heat sink 32 keep a distance from the cover 50. Thus, air between the cover 50 and the fins 325 can communicate with cooling air in ambience. The triangular arrangement of the condensers 356 of the heat pipes 30 provides a steady support for the cover 50. The cover 50 also can be supported by a lamp post so as to decrease burden on the heat pipes 30.

Figure 5:
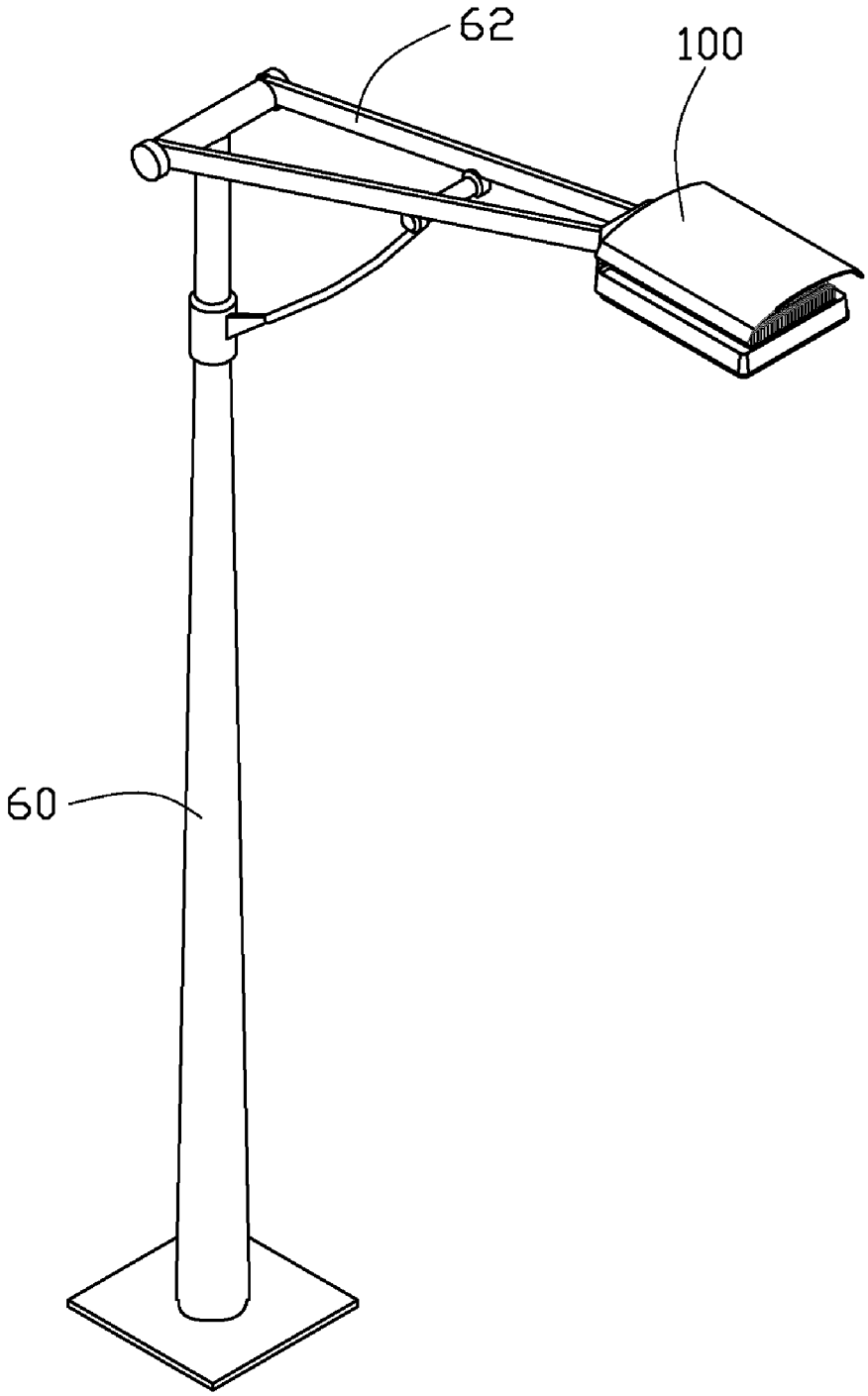
FIG. 5 is an assembled, isometric view of a lamp post and the LED lamp shown in FIG. 2.

Please referring to FIG. 5, the LED lamp 100 is connected to a lamp post 60 and is used as a street lamp. The lamp post 60 has an arm 62 extending laterally from a top. The arm 62 engages in the fixing hole 1262 of the connecting portion 126 thereby to connect with the connecting portion 126. Thus, the LED lamp 100 is fixedly supported by the lamp post 60. The cover 50 shields the top of the fins 325 so that dust, snow or ice piling up the fins 325 can be greatly reduced. Furthermore, heat generated by the LED modules 20 can be transferred to the cover 50 via the heat pipes 35 so as to enhance heat dissipating efficiency by utilizing a large area of the cover 50. Moreover, the cover 50 is spaced from the heat sink 32 so that the heat sink 32 can disperse the heat to an ambient air more quickly.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:
a frame;
at least one LED module having a plurality of LEDs;
a heat sink on which the at least one LED module is attached, the heat sink being mounted on the frame;
at least a heat pipe; and
a cover; wherein
two ends of the at least a heat pipe are respectively connected to the heat sink and the cover, the cover shields a top portion of the heat sink and spaces from the top portion of the heat sink.

2. The LED lamp as claimed in claim 1, wherein the cover has an arch shape, the cover has an outer surface having a protruding shape and an internal surface having a concave shape, the outer surface has a smooth surface, the internal surface faces towards the top portion of the heat sink.

3. The LED lamp as claimed in claim 1, wherein the at least a heat pipe has a number of three, and the cover is secured by the three heat pipes.

4. The LED lamp as claimed in claim 3, wherein the heat pipes respectively locate at three points of a triangle.

5. The LED lamp as claimed in claim 1, wherein the at least a heat pipe has a horizontal evaporator, a vertical connection and a horizontal condenser, the evaporator and the condenser respectively connect with two ends of the connection.

6. The LED lamp as claimed in claim 5, wherein a length of the connection of the at least a heat pipe is longer than a vertical length of the heat sink.

7. The LED lamp as claimed in claim 5, wherein the heat sink comprises a base and a plurality of fins extending from a top portion of the base, the evaporator of the at least a heat pipe is attached to the base, the connection extends through the base and the fins vertically.

8. The LED lamp as claimed in claim 5, wherein an internal surface of the cover defines an elongate groove correspondingly for receiving the condenser of the at least a heat pipe.

9. The LED lamp as claimed in claim 8 further comprising a board which is used to attach the condenser of the at least a heat pipe to the cover by one of soldering and fastening.

10. A street lamp comprising:
a lamp post; and
an LED lamp connecting to the lamp post and comprising:
a plurality of LEDs for generating light;
a heat sink on which the LEDs are attached;
a plurality of heat pipes; and
a cover; wherein
two ends of each of the heat pipes are respectively connected to the heat sink and the cover so as to make the cover shield a top portion of the heat sink and the cover is spaced from the top portion of the heat sink.

11. The street lamp as claimed in claim 10, wherein the cover has an arch shape, the cover has an outer surface having a protruding shape and an internal surface having a concave shape, the outer surface has a smooth surface, the internal surface is oriented towards the top portion of the heat sink.

12. The street lamp as claimed in claim 11, wherein top ends of the heat pipes are attached to the internal surface of the cover and secured to the internal surface of the cover by a plurality of boards, respectively.

13. The street lamp as claimed in claim 11, wherein the heat sink has a plurality of fins formed on the top portion thereof.

14. The street lamp as claimed in claim 10, wherein the heat pipes have a number of three, and the three heat pipes are respectively locate at three points of a triangle, the cover is supported by the three heat pipes.

15. The street lamp as claimed in claim 10, wherein a length of each of the heat pipes is longer than a vertical length of the heat sink.

16. The street lamp as claimed in claim 10, wherein the heat sink comprises a plurality of fins, and the heat pipes extend upwardly from the fins.

* * * * *